US009733601B2

(12) United States Patent
Kasama et al.

(10) Patent No.: US 9,733,601 B2
(45) Date of Patent: Aug. 15, 2017

(54) FIXING DEVICE AND IMAGE FORMING APPARATUS

(71) Applicant: KYOCERA Document Solutions Inc., Osaka (JP)

(72) Inventors: Kenichi Kasama, Osaka (JP); Shoko Gon, Osaka (JP); Akihiro Kondo, Osaka (JP); Eiji Nakajima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/131,486

(22) Filed: Apr. 18, 2016

(65) Prior Publication Data

US 2016/0306308 A1 Oct. 20, 2016

(30) Foreign Application Priority Data

Apr. 20, 2015 (JP) ..... 2015-085774

(51) Int. Cl.
*G03G 15/00* (2006.01)
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 15/2064; G03G 15/2042; G03G 15/2039; G03G 2215/2035
USPC ..... 399/328–330
See application file for complete search history.

(56) References Cited

U.S. PATENT DOCUMENTS

2012/0308278 A1* 12/2012 Kikuchi ..... H05B 6/145 399/329

FOREIGN PATENT DOCUMENTS

JP 2013-041223 A 2/2013

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A fixing device includes a fixing belt, a pressuring member, an exciting coil and a belt guide. The pressuring member comes into pressure contact with the fixing belt to form a fixing nip. The exciting coil is provided at an outer diameter side of the fixing belt and configured to generate a magnetic flux to inductively heat the fixing belt. The belt guide supports the fixing belt from an inner diameter side. The belt guide includes a contact part which is in contact with an inner circumferential face of the fixing belt and a non-contact part which is not in contact with the inner circumferential face of the fixing belt. The non-contact part is provided with a slit configured to inhibit induction heating of the non-contact part due to the magnetic flux generated by the exciting coil.

10 Claims, 4 Drawing Sheets

FIXING DEVICE AND IMAGE FORMING APPARATUS

INCORPORATION BY REFERENCE

This application is based on and claims the benefit of priority from Japanese patent application No. 2015-085774 filed on Apr. 20, 2015, the entire contents of which are incorporated herein by reference.

BACKGROUND

The present disclosure relates to a fixing device fixing a toner image on a sheet and an image forming apparatus including the fixing device.

Conventionally, an electrographic image forming apparatus, such as a copying machine or a printer, includes a fixing device fixing a toner image on a sheet.

For example, there is a fixing device including a fixing belt, a pressuring member configured to come into pressure contact with the fixing belt to form a fixing nip, an exciting coil provided at an outer diameter side of the fixing belt and a belt guide configured to support the fixing belt from an inner diameter side of the fixing belt. For example, the belt guide includes a contact part configured to be in contact with an inner circumferential face of the fixing belt and a non-contact part configured to be not in contact with the inner circumferential face of the fixing belt.

SUMMARY

In accordance with an embodiment of the present disclosure, a fixing device includes a fixing belt, a pressuring member, an exciting coil and a belt guide. The pressuring member is configured to come into pressure contact with the fixing belt to form a fixing nip. The exciting coil is provided at an outer diameter side of the fixing belt and configured to generate a magnetic flux to inductively heat the fixing belt. The belt guide is configured to support the fixing belt from an inner diameter side of the fixing belt. The belt guide includes a contact part which is in contact with an inner circumferential face of the fixing belt and a non-contact part which is not in contact with the inner circumferential face of the fixing belt. The non-contact part is provided with a slit configured to inhibit induction heating of the non-contact part due to the magnetic flux generated by the exciting coil.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
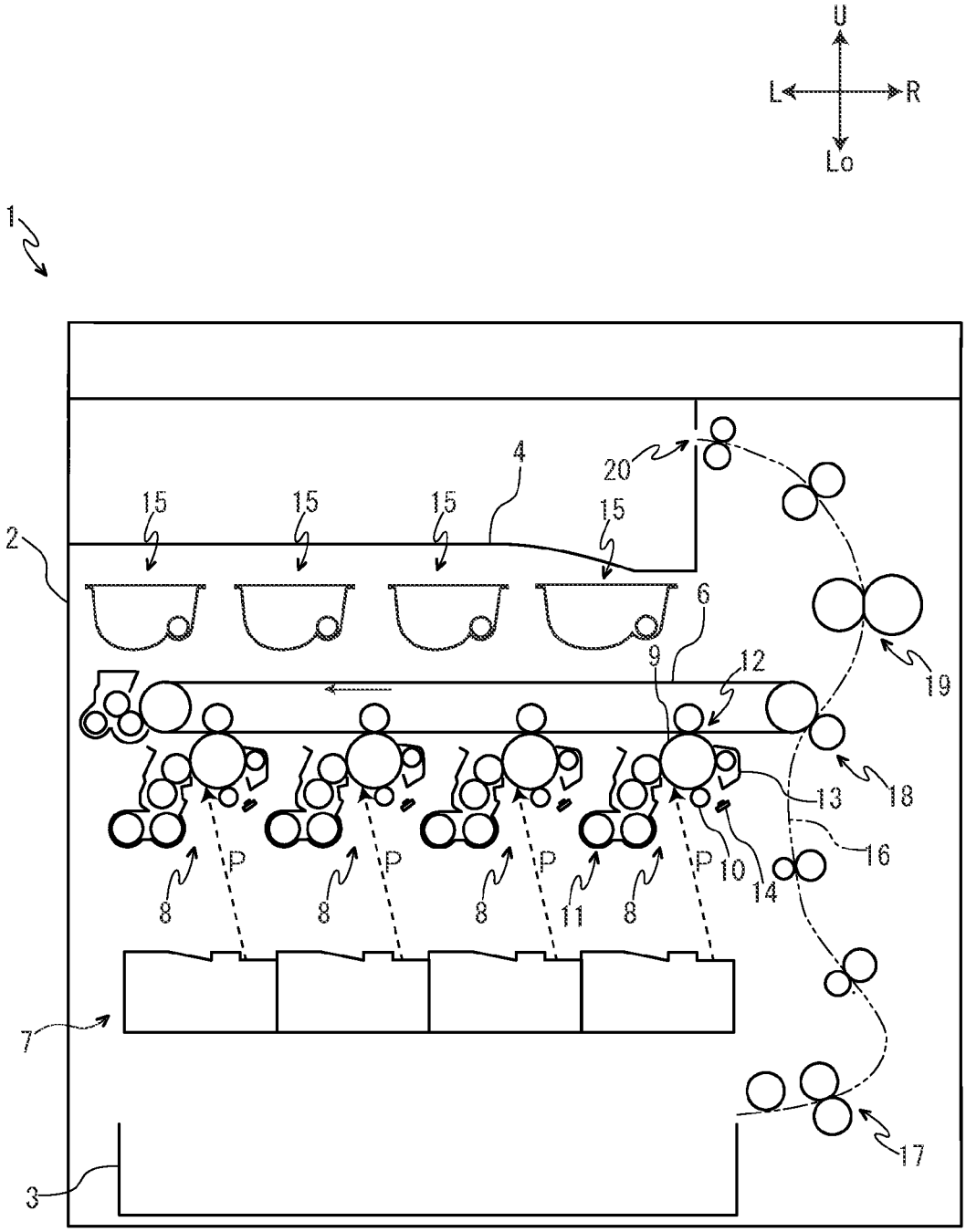
FIG. 1 is a schematic view showing an outline of a color printer according to a first embodiment of the present disclosure.

Hereinafter, with reference to drawings, a color printer 1 (image forming apparatus) according to a first embodiment of the present disclosure will be explained. For convenience of explanation, a front side of FIG. 1 is regarded as a front side of the printer 1. Arrows Fr, Rr, L, R, U and Lo appropriately added to each of the drawings indicate the front side, rear side, left side, right side, upper side and lower side of the color printer 1, respectively.

Firstly, with reference to FIG. 1, the entire structure of a color printer 1 will be described.

The color printer 1 includes a box-formed printer main body 2. In a lower part of the printer main body 2, a sheet feeding cartridge 3 storing a sheet is arranged. In an upper part of the printer main body 2, an ejected sheet tray 4 is arranged.

In a middle part inside the printer main body 2, an intermediate transferring belt 6 is disposed around a plurality of rollers. Below the intermediate transferring belt 6, an exposure device 7 composed of a laser scanning unit (LSU) is arranged. At a lower side of the intermediate transferring belt 6, four image forming parts 8 are installed for respective colors (e.g. four colors of magenta, cyan, yellow and black) of a toner. In each image forming part 8, a photosensitive drum 9 is rotatably arranged. Around the photosensitive drum 9, a charger 10, a development device 11, a first transferring part 12, a cleaning device 13 and a static eliminator 14 are located in order of first transferring processes. Above the development device 11, each of toner containers 15 corresponding to the respective image forming parts 8 are arranged for the respective toner colors (e.g. four colors of magenta, cyan, yellow and black).

In a right side part of the printer main body 2, a conveying path 16 for the sheet is arranged in an upper and lower direction. At an upstream end of the conveying path 16, a sheet feeding part 17 is positioned. At a middle stream part of the conveying path 16, a second transferring part 18 is positioned at a right end side of the intermediate transferring belt 6. At a downstream part of the conveying path 16, a fixing device 19 is positioned. At a downstream end of the conveying path 16, a sheet ejection port 20 is positioned.

Next, the operation of forming an image by the color printer 1 having such a configuration will be described. When the power is supplied to the color printer 1, various parameters are initialized and initial determination, such as temperature determination of the fixing device 19, is carried out. Subsequently, in the color printer 1, when image data is inputted and a printing start is directed from a computer or the like connected with the color printer 1, image forming operation is carried out as follows.

Firstly, the surface of the photosensitive drum 9 is electrically charged by the charger 10. Then, an electrostatic latent image is formed on the surface of the photosensitive drum 9 by a laser light (refer to an arrow P) from the exposure device 7. The electrostatic latent image is developed to a toner image having a correspondent color in the development device 11 by the toner supplied from each toner container 15. The toner image is first-transferred onto the surface of the intermediate transferring belt 6 in the first transferring part 12. The above-mentioned operation is repeated in order by the respective image forming parts 8, thereby forming the toner image having full color onto the intermediate transferring belt 6. Incidentally, the toner and electric charge remained on the photosensitive drum 9 are removed by the cleaning device 13 and the static eliminator 14.

On the other hand, the sheet fed from the sheet feeding cartridge 3 or a manual bypass tray (not shown) by the sheet feeding part 17 is conveyed to the second transferring part 18 in a suitable timing for the above-mentioned image forming operation. Then, in the second transferring part 18, the toner image having full color on the intermediate transferring belt 6 is second-transferred onto the sheet. The sheet with the second-transferred toner image is conveyed to a downstream side on the conveying path 16 to enter the fixing device 19, and then, the toner image is fixed on the sheet in the fixing device 19. The sheet with the fixed toner image is ejected from the sheet ejection port 20 onto the ejected sheet tray 4.

Next, the fixing device 19 will be described with reference to FIGS. 2 and 3. Incidentally, an arrow A in FIG. 2 indicates a sheet conveying direction (a direction from a lower side to an upper side in the present embodiment).

Figure 2:
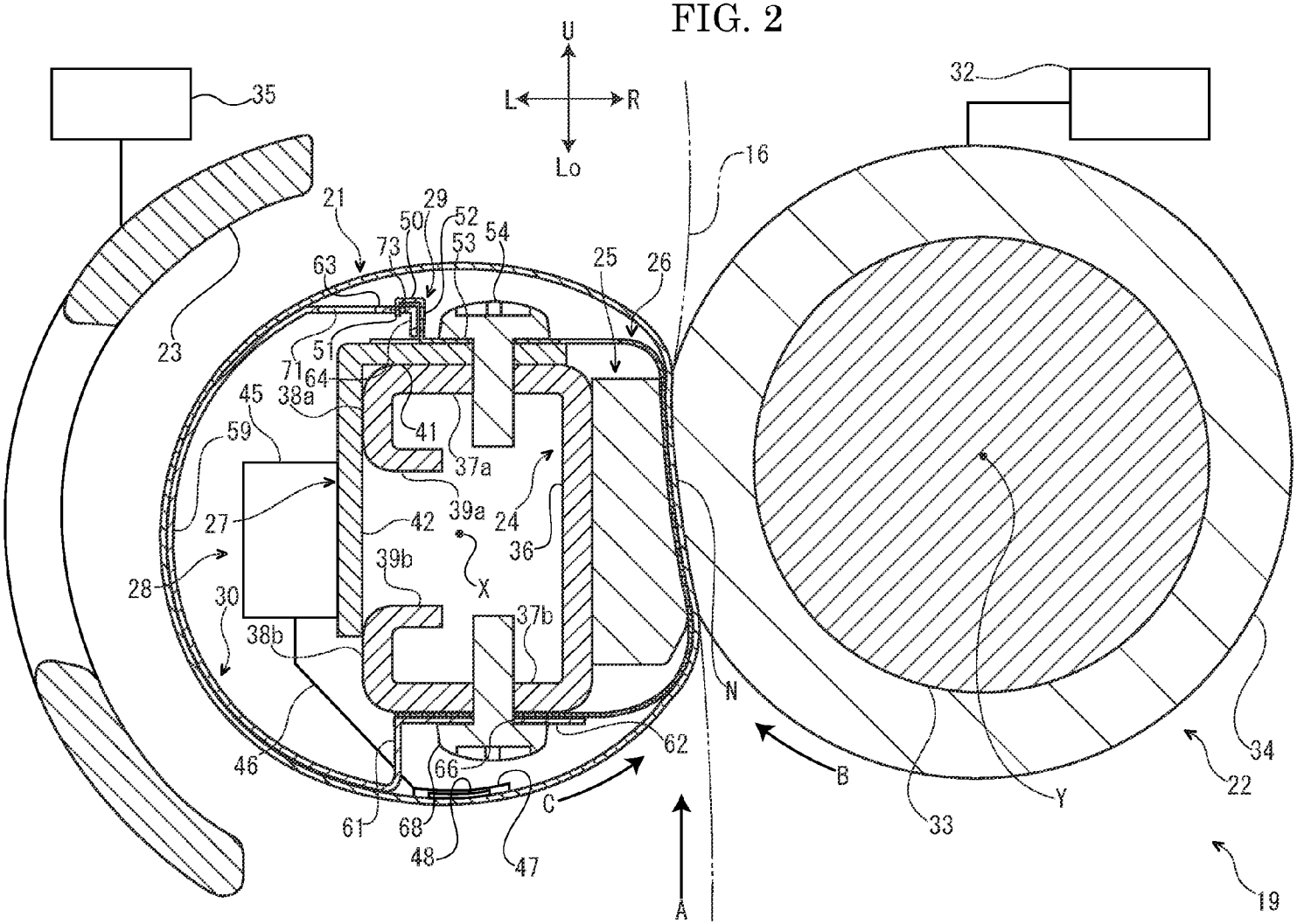
FIG. 2 is a sectional view showing a fixing device according to the first embodiment of the present disclosure.

As shown in FIG. 2, the fixing device 19 includes a fixing belt 21, a pressuring roller 22 (pressuring member) provided at a right side (outer diameter side) of the fixing belt 21, an exciting coil 23 provided at a left side (outer diameter side) of the fixing belt 21, a supporting member 24 provided at an inner diameter side of the fixing belt 21, a pressing member 25 provided at a right side of the supporting member 24 at the inner diameter side of the fixing belt 21, a sheet member 26 provided so as to cover both upper and lower sides and a right side of the supporting member 24 and the pressing member 25 at the inner diameter side of the fixing belt 21, a retaining member 27 provided from a left side to the upper side of the supporting member 24 at the inner diameter side of the fixing belt 21, a temperature sensor 28 provided from the left side to the lower side of the supporting member 24 at the inner diameter side of the fixing belt 21, a plurality of attachment members 29 provided at the upper side of the supporting member 24 at the inner diameter side of the fixing belt 21, and a belt guide 30 provided so as to cover the lower side and the left side of the supporting member 24 at the inner diameter side of the fixing belt 21.

The fixing belt 21 is formed in a cylindrical shape elongated in a front and rear direction. That is, in the present embodiment, a longitudinal direction of the fixing belt 21 is the front and rear direction. The fixing belt 21 is a thin belt having flexibility, and is endless in a circumferential direction. The fixing belt 21 is provided rotatably around a rotation axis X. An outer diameter of the fixing belt 21 is 20 mm to 50 mm, for example.

The fixing belt 21 includes a base material layer, an elastic layer provided around this base material layer, and a release layer covering this elastic layer, for example. The base material layer of the fixing belt 21 is made of Ni (nickel) whose thickness is 30 μm to 50 μm or is made of a polyimide resin whose thickness is 50 μm to 100 μm, for example. When the base material layer of the fixing belt 21 is made of the polyimide resin, metal powders, such as Cu (copper), Ag (silver) and Al (aluminum), may be mixed in the polyimide resin. The elastic layer of the fixing belt 21 is made of a silicone rubber whose thickness is 100 μm to 500 μm. The release layer of the fixing belt 21 is made of a fluorine resin, such as a PFA, whose thickness is 30 μm to 50 μm, for example. Incidentally, in each drawing, each layer (the base material layer, the elastic layer and the release layer) of the fixing belt 21 is shown without being distinguished in particular.

At an inner circumferential face of the fixing belt 21 and at a part which slides with respect to the sheet member 26, a coating made of a polyimide, a polyamide imide, a fluorine resin (e.g. PTFE) or the like is applied.

The pressuring roller 22 is formed in a columnar shape elongated in the front and rear direction. The pressuring roller 22 comes into pressure contact with the fixing belt 21 to form a fixing nip N between the fixing belt 21 and the pressuring roller 22. The pressuring roller 22 is provided rotatably around a rotation axis Y. The rotation axis Y of the pressuring roller 22 is provided at an upper side (at a downstream side in the sheet conveying direction) of the rotation axis X of the fixing belt 21. The pressuring roller 22 is connected to a driving source 32 composed of a motor or the like.

The pressuring roller 22 includes a columnar core material 33, an elastic layer 34 provided around this core material 33, and a release layer (not shown) covering this elastic layer 34. The core material 33 of the pressuring roller 22 is made of a metal, such as stainless steel or aluminum. The elastic layer 34 of the pressuring roller 22 is made of a silicone rubber or a silicone sponge, for example. The release layer (not shown) of the pressuring roller 22 is made of a fluorine resin, such as a PFA.

The exciting coil 23 is formed in a shape elongated in the front and rear direction. The exciting coil 23 is formed by winding copper wires, for example. The exciting coil 23 is arranged at a side opposite to the fixing nip N when seen from the rotation axis X of the fixing belt 21. The exciting coil 23 is arcuately arranged along an outer circumferential face of the fixing belt 21. The exciting coil 23 is connected to a power supply 35.

The supporting member 24 is formed in a shape elongated in the front and rear direction. The supporting member 24 is formed by bending one plate metal.

The supporting member 24 includes a sidewall part 36, both upper and lower wall parts 37*a* and 37*b* which are bent from both upper and lower end parts of the sidewall part 36 toward the left side, a pair of upper and lower first reinforcing wall parts 38*a* and 38*b* which are bent from left end parts of the both upper and lower wall parts 37*a* and 37*b* toward an inside in upper and lower direction (a lower side of the upper wall part 37*a* and the upper side of the lower wall part 37*b*), and a pair of upper and lower second reinforcing wall parts 39*a* and 39*b* which are bent from end parts at the inside of the upper and lower direction of a pair of the upper and lower first reinforcing wall parts 38*a* and 38*b* (a lower end part of the upper first reinforcing wall part 38*a* and an upper end part of the lower first reinforcing wall part 38*b*) toward the right side.

The pressing member 25 is formed in a shape elongated in the front and rear direction. The pressing member 25 is made of a heat resistant resin, such as an LCP (liquid crystal polymer). A left face (inner face) of the pressing member 25 is fixed to a right face (outer face) of the sidewall part 36 of the supporting member 24. Thus, the pressing member 25 is supported by the supporting member 24.

A right face (outer face) of the pressing member 25 presses the fixing belt 21 toward the right side (the side of the pressuring roller 22) via the sheet member 26. The right face of the pressing member 25 is inclined to the left side (the inner diameter side of the fixing belt 21) toward the upper side (the downstream side in the sheet conveying direction). The right face of the pressing member 25 is provided with an elastomer layer, such as a silicon rubber.

The sheet member 26 is formed in a shape elongated in the front and rear direction. The sheet member 26 is made of a fluorine resin (e.g. PTFE), and has a smaller friction coefficient than that of the pressing member 25. A center part of the sheet member 26 in the upper and lower direction is interposed between the fixing belt 21 and the pressing member 25, and is in contact with an inner circumferential face of the fixing belt 21.

The retaining member 27 is made of a plate metal, for example. The retaining member 27 includes a first flat part 41 extending in a horizontal direction, and a second flat part 42 bent from a left end part of the first flat part 41 toward a lower side, and extending in a vertical direction.

The temperature sensor 28 includes a base part 45, a leaf spring 46 whose one end part is attached to the base part 45, a sponge 47 (elastic member) attached to the other end part of the leaf spring 46, and a thermistor 48 (detecting element) attached to the sponge 47. The base part 45 is fixed to a left face (outer face) of the second flat part 42 of the retaining member 27. Thus, the temperature sensor 28 is retained by the retaining member 27. The thermistor 48 comes into contact with the inner circumferential face of the fixing belt 21, and has a function of detecting a temperature of the inner circumferential face of the fixing belt 21.

A plurality of the attachment members 29 are provided at positions meeting both front and rear parts and a center part of the fixing belt 21 in the front and rear direction. Each attachment part 29 is formed by bending one plate metal.

Each attachment member 29 includes an attachment plate 50, an engaging plate 51 bent from a left end part (an end part at a far side from the fixing nip N) of the attachment plate 50 toward the lower side (the inner diameter side of the fixing belt 21), a connecting plate 52 bent from a right end part (an end part at the side of the fixing nip N) of the attachment plate 50 toward the lower side (the inner diameter side of the fixing belt 21), and a fixed plate 53 bent from a lower end part (an end part at the inner diameter side of the fixing belt 21) of the connecting plate 52 toward the right side (the side of the fixing nip N). The fixed plate 53 and the first flat part 41 of the retaining member 27 are fixed to a top face of the upper wall part 37*a* of the supporting member 24 (a downstream side face of the supporting member 24 in the sheet conveying direction) by a downstream side fixing screw 54.

The belt guide 30 is formed in a shape elongated in the front and rear direction. The belt guide 30 is formed by bending one plate metal made of a magnetic metal, such as SUS 430, for example. The thickness of the belt guide 30 is 0.1 mm to 0.5 mm, for example.

Figure 3:
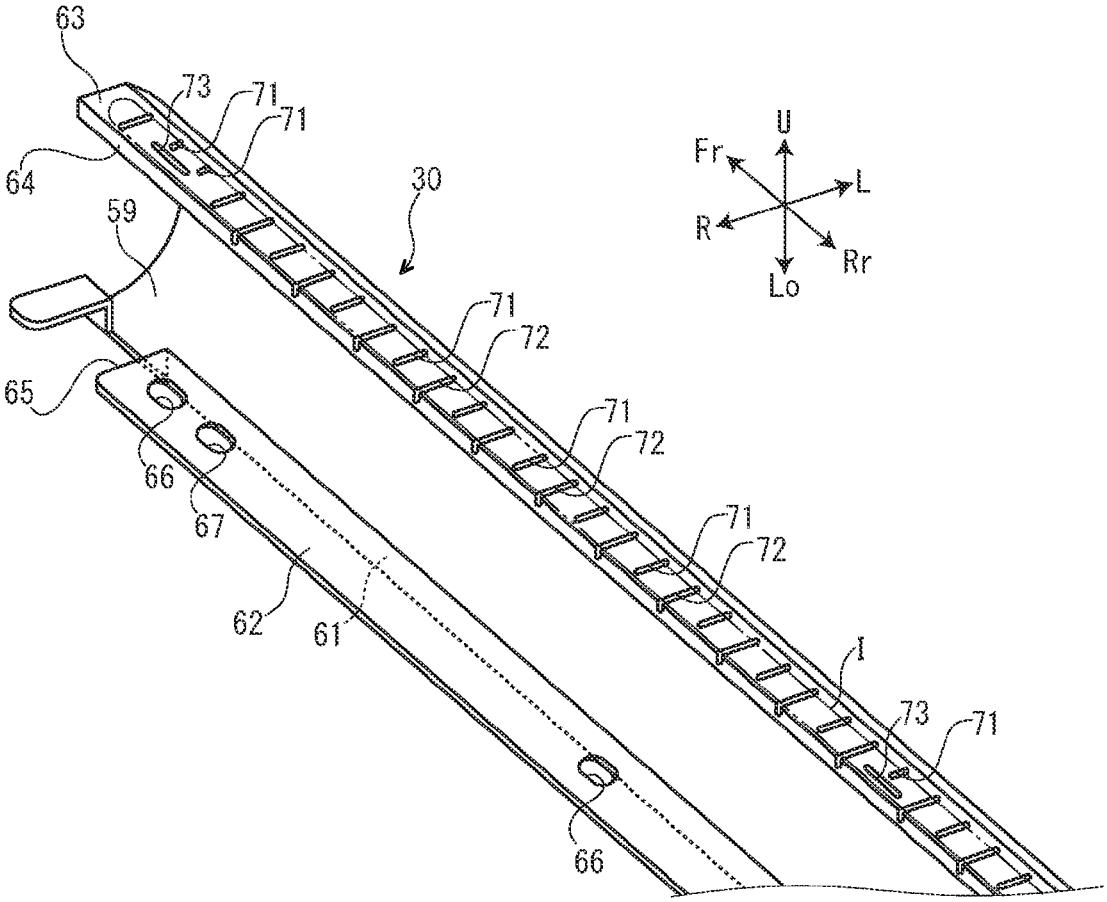
FIG. 3 is a perspective view showing a belt guide according to the first embodiment of the present disclosure.

As shown in FIGS. 2 and 3, the belt guide 30 includes a contact part 59, a first upstream part 61 bent at an acute angle from a lower end part (an upstream side end part in the sheet conveying direction) of the contact part 59 toward the upper side (the inner diameter side of the fixing belt 21), a second upstream part 62 bent at an approximately right angle from an upper end part (the end part at the inner diameter side of the fixing belt 21) of the first upstream part 61 toward the right side (the side of the fixing nip N), a non-contact part 63 bent at an obtuse angle from an upper end part (a downstream side end part in the sheet conveying direction) of the contact part 59 toward the right side (the side of the fixing nip N), and a bent part 64 bent at an approximately right angle from a right end part (an end part at the side of the fixing nip N) of the non-contact part 63 toward the lower side (the inner diameter side of the fixing belt 21).

The contact part 59 of the belt guide 30 is arcuately curved along the inner circumferential face of the fixing belt 21, and is entirely in contact with the inner circumferential face of the fixing belt 21. Thus, the belt guide 30 supports the fixing belt 21 from the inner diameter side of the fixing belt 21. The contact part 59 faces the exciting coil 23 across the fixing belt 21. The contact part 59 is arranged at a side opposite to the fixing nip N when seen from the rotation axis X of the fixing belt 21.

The first upstream part 61 and the second upstream part 62 of the belt guide 30 are provided at a lower part (an upstream side part in the sheet conveying direction) of the belt guide 30. The first upstream part 61 and the second upstream part 62 are formed in flat shapes. The first upstream part 61 and the second upstream part 62 are not in contact with the inner circumferential face of the fixing belt 21. The first upstream part 61 and the second upstream part 62 of the belt guide 30 are not provided with slits.

The belt guide 30 is provided with a cutout part across the first upstream part 61 and the second upstream part 62. In the cutout part 65, the leaf spring 46 of the temperature sensor 28 is inserted. The second upstream part 62 is provided with fixing holes 66, and, by upstream side fixing screws 68 which penetrate through the fixing holes 66, the second upstream part 62 and a lower end part of the sheet member 26 are fixed to the lower wall part 37*b* of the supporting member 24. The second upstream part 62 is provided with a positioning long hole 67.

The non-contact part 63 and the bent part 64 of the belt guide 30 are provided at an upper part (a downstream side part in the sheet conveying direction) of the belt guide 30. The non-contact part 63 and the bent part 64 are formed in flat shapes. The non-contact part 63 and the bent part 64 are not in contact with the inner circumferential face of the fixing belt 21.

The belt guide 30 is provided with a plurality of first slits 71 provided within the non-contact part 63, and is provided with a plurality of second slits 72 provided across the non-contact part 63 and the bent part 64. Each first slit 71 and each second slit 72 (hereinafter, referred to as "each slit 71 and 72" occasionally) are alternately provided. Each slit 71 and is formed in a shape elongated in a left and right direction (a direction orthogonally crossing to the longitudinal direction of the fixing belt 21), and is provided at intervals in the front and rear direction. Formation intervals of each slit 71 and 72 is 5 mm to 15 mm, for example, and a formation width of each slit 71 and 72 is 0.2 mm to 1 mm, for example.

In the non-contact part 63 of the belt guide 30, engaging holes 73 are provided at the both front and rear end parts and the center part in the front and rear direction. Each engaging hole 73 is formed in a shape elongated in the front and rear direction, and is arranged so as not to overlap each slit 71 and 72. With each engaging hole 73, the engaging plate 51 of each attachment member 29 is engaged. Thus, the non-contact part 63 is attached to each attachment member 29, and the non-contact part 63 is retained by the supporting member 24 via each attachment member 29.

When a toner image is fixed onto a sheet in the fixing device 19 applying the above-mentioned configuration, the driving source 32 rotates the pressuring roller 22 (see an arrow B in FIG. 2). According to this, the fixing belt 21 which comes into pressure contact with the pressuring roller 22 rotates with a rotation of the pressuring roller 22 (see an arrow C in FIG. 2).

Further, when a toner image is fixed onto a sheet, the power supply 35 applies a high-frequency current to the exciting coil 23. According to this, the exciting coil 23 generates a magnetic flux, this magnetic flux is absorbed by the fixing belt 21 and then the fixing belt 21 generates a heat. That is, the exciting coil 23 inductively heats the fixing belt 21. In this state, when the sheet passes through the fixing nip N, the sheet and the toner image are heated and pressured, so that the toner image is fixed onto the sheet.

In the present embodiment, as mentioned above, the contact part 59 of the belt guide 30 is in contact with the inner circumferential face of the fixing belt 21. Consequently, it is possible to stabilize a rotation orbit of the fixing belt 21, and keep a fixed distance between the fixing belt 21 and the exciting coil 23.

Further, as mentioned above, the contact part 59 of the belt guide 30 is in contact with the inner circumferential face of the fixing belt 21, and therefore when a magnetic flux (hereinafter, referred to as a "leaking magnetic flux") having passed through the fixing belt 21 is absorbed by the contact part 59 of the belt guide 30, the contact part 59 generates a heat and a heat transfer from the contact part 59 heats the fixing belt 21. Consequently, it is possible to increase heating efficiency of the fixing belt 21 and enhance power saving performance.

Meanwhile, when the leaking magnetic flux is absorbed by the non-contact part 63 of the belt guide 30, the non-contact part 63 generates heat. The non-contact part 63 is not in contact with the inner circumferential face of the fixing belt 21, and therefore it is impossible to transfer a heat from the non-contact part 63 to the fixing belt 21 and the heat concentrates on the non-contact part 63. According to this, it is concerned that an excessive rise in the temperature of the non-contact part 63 causes the heat to escape from the non-contact part 63 to the supporting member 24 via each attachment part 29, to excessively raise the temperature of the supporting member 24 and to lower the heating efficiency of the fixing belt 21.

Hence, in the present embodiment, as mentioned above, the non-contact part 63 of the belt guide 30 is provided with each slit 71 and 72. By applying such a configuration, when a leaking magnetic flux is absorbed by the non-contact part 63 and when an eddy current I (see FIG. 3) is generated in the non-contact part 63, this eddy current I is divided by each slit 71 and 72. According to this, it is possible to inhibit heat generation of the non-contact part 63, and inhibit an excessive rise of the temperature of the non-contact part 63. Consequently, it is possible to prevent the heat from escaping from the non-contact part 63 to the supporting member 24 via each attachment member 29, inhibit an excessive rise in the temperature of the supporting member 24 and enhance heating efficiency of the fixing belt 21.

Further, when the fixing belt 21 is rotated as mentioned above, the upper part (a downstream side part in the sheet conveying direction) of the fixing belt 21 is released by the fixing nip N and likely to be loosened. It is concerned that, when the upper part of the fixing belt 21 is loosened in this way, the contact between the inner circumferential face of the fixing belt 21 and the upper part of the belt guide 30 becomes unstable, and the temperature of the upper part of the belt guide 30 excessively rises.

Hence, in the present embodiment, the non-contact part 63 of the belt guide 30 is bent at the obtuse angle from the upper end part (the downstream side end part in the sheet conveying direction) of the contact part 59 toward the right side (the side of the fixing nip N). By applying such a configuration, the upper part of the contact part 59 of the belt guide 30 can be cut off in advance to form the non-contact part 63. Consequently, it is possible to clearly separate the contact part 59 and the non-contact part 63 of the belt guide 30, and prevent a part of the belt guide 30 from unstably coming into contact with the inner circumferential face of the fixing belt 21 (from being in a state where it is impossible to decide whether or not the part comes into contact with the inner circumferential face of the fixing belt 21). According to this, it is possible to prevent a situation that, the temperature of the belt guide 30 excessively rises at a part at which the contact with the inner circumferential face of the fixing belt 21 is unstable.

Incidentally, when the fixing belt 21 is rotated as mentioned above, the lower part (the upstream side part in the sheet conveying direction) of the fixing belt 21 is pulled toward the fixing nip N, and therefore is hardly loosened. For this reason, in the present embodiment, the first upstream part 61 provided at the lower part (the upstream side part in the sheet conveying direction) of the belt guide 30 is not provided with each slit 71 and 72. By applying such a configuration, compared to a case where both of the non-contact part 63 and the first upstream part 61 of the belt guide 30 are provided with each slit 71 and 72, it is possible to simplify the configuration of the belt guide 30.

Further, each slit 71 and 72 is provided at intervals in the front and rear direction (the longitudinal direction of the fixing belt 21). Consequently, it is possible to effectively inhibit an excessive rise in the temperature of the non-contact part 63 of the belt guide 30.

Further, the belt guide 30 is provided with a plurality of first slits 71 provided within the non-contact part 63 and a plurality of second slits 72 provide across the non-contact part 63 and the bent part 64, and each first slit 71 and each second slit 72 are alternately provided. By applying such a configuration, while inhibiting a decrease in the strength of the belt guide 30, it is possible to reliably inhibit an excessive rise of the temperature of the non-contact part 63 of the belt guide 30.

Further, the fixing device 19 includes the pressing member 25 which presses the fixing belt 21 toward the right side (the side of the pressuring roller 22), and the supporting member 24 which supports the pressing member 25. By applying such a configuration, it is possible to reduce a heat capacity of the fixing device 19 and save energy.

Further, the non-contact part 63 of the belt guide 30 is attached to each attachment member 29. Furthermore, as mentioned above, within the non-contact part 63, each slit 71 and 72 is provided, so that the temperature of the non-contact part 63 is not likely to rise. Consequently, the non-contact part 63 is set as an attachment part for each attachment member 29, so that it is possible to effectively inhibit excessive rises in temperatures of each attachment member 29 and the supporting member 24.

In the present embodiment, the non-contact part (a part at a downstream side in the sheet conveying direction) of the belt guide 30 is retained by the supporting member 24 via each attachment member 29. In another embodiment, the non-contact part 63 (a part at a downstream side in the sheet conveying direction) of the belt guide 30 may be directly retained by the supporting member 24.

In the present embodiment, the belt guide 30 is provided with both of the first slits 71 (the slits provided within the non-contact part 63) and the second slits 72 (the slits provided across the non-contact part 63 and the bent part 64). In another embodiment, the belt guide 30 may be provided with only one of the first slits 71 or the second slits 72.

In the present embodiment, the driving source 32 is connected to the pressuring roller 22. In another embodiment, the driving source 32 may be connected with the fixing belt 21.

In the present embodiment, the configuration of the present disclosure is adopted to the color printer 1. In another embodiment, the configuration of the present disclosure may be adopted to an image forming apparatus other than the color printer 1, such as a monochrome printer, a copying machine, a facsimile, or a multifunction peripheral.

Second Embodiment

Figure 4:
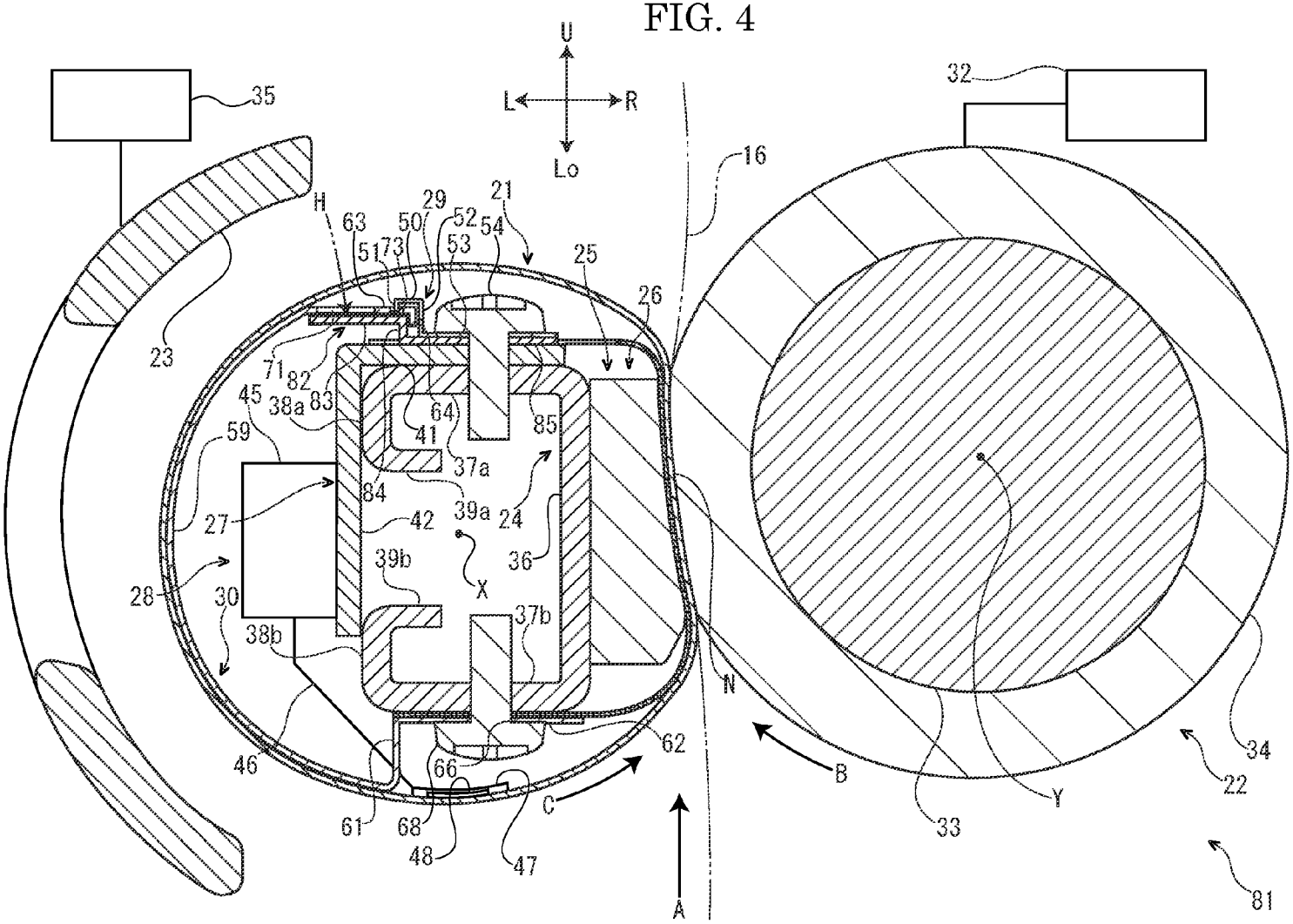
FIG. 4 is a sectional view showing a fixing device according to a second embodiment of the present disclosure.

Next, a fixing device 81 according to the second embodiment of the present disclosure will be described with reference to FIG. 4. Incidentally, components other than a magnetic flux blocking member 82 are the same as those of the first embodiment, and therefore will not be described.

The magnetic flux blocking member 82 is formed in a shape elongated in the front and rear direction. The magnetic flux blocking member 82 is made of a non-magnetic metal which has electrical conductivity, such as aluminum or copper.

The magnetic flux blocking member 82 includes a blocking part 83, a connecting part 84 bent from a right end part (an end part at the side of the fixing nip N) of the blocking part 83 toward the lower side (the inner diameter side of the fixing belt 21), and a fixed part 85 bent from a lower end part (an end part at the inner diameter side of the fixing belt 21) of the connecting part 84 toward the right side (the side of the fixing nip N). The blocking part 83 is provided at a lower side (the side of the supporting member 24) of the non-contact part 63 of the belt guide 30. The blocking part 83 may be in contact with the non-contact part 63 of the belt guide 30, or may not be in contact with the non-contact part 63 of the belt guide 30. The blocking part 83 is provided between a left side part of the supporting member 24 and the non-contact part 63 of the belt guide 30. The fixed part 85 is fixed to the top face of the upper wall part 37*a* of the supporting member 24 (the downstream side face in the sheet conveying direction of the supporting member 24).

In the fixing device 81 applying the above-mentioned configuration, a magnetic flux (see an arrow H in FIG. 4) passes through each slit 71 and 72 is blocked and absorbed by the blocking part 83 of the magnetic flux blocking member 82. Consequently, it is possible to inhibit absorption of the magnetic flux passes through each slit 71 and 72 by the supporting member 24, and inhibit an excessive rise of the temperature of the supporting member 24.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a fixing belt;

a pressuring member configured to come into pressure contact with the fixing belt to form a fixing nip;

an exciting coil provided at an outer diameter side of the fixing belt and configured to generate a magnetic flux to inductively heat the fixing belt; and a belt guide configured to support the fixing belt from an inner diameter side of the fixing belt, wherein the belt guide includes:

a contact part which is in contact with an inner circumferential face of the fixing belt; and a non-contact part which is not in contact with the inner circumferential face of the fixing belt, and the non-contact part is provided with a slit configured to inhibit induction heating of the non-contact part due to the magnetic flux generated by the exciting coil, wherein the contact part is arcuately curved along the inner circumferential face of the fixing belt, and the non-contact part is bent at an obtuse angle from a downstream side end part in a sheet conveying direction of the contact part toward a side of the fixing nip.

2. The fixing device according to claim 1, wherein there are a plurality of slits provided at an interval in a longitudinal direction of the fixing belt.

3. The fixing device according to claim 2, wherein the belt guide further includes a bent part configured to be bent from the non-contact part toward the inner diameter side of the fixing belt, wherein a plurality of the slits include:

a plurality of first slits provided within the non-contact part; and a plurality of second slits provided across the non-contact part and the bent part, and wherein each of the first slits and each of the second slits are alternately provided.

4. The fixing device according to claim 1, further comprising:

a pressing member configured to press the fixing belt toward a side of the pressuring member; and a supporting member configured to support the pressing member.

5. The fixing device according to claim 4, wherein a magnetic flux blocking member configured to block the magnetic flux which passes through the slit is provided between the supporting member and the non-contact part.

6. The fixing device according to claim 4, further comprising an attachment member fixed to the supporting member, wherein the non-contact part is attached to the attachment member.

7. The fixing device according to claim 6, wherein an engaging hole is provided in the non-contact part so as not to overlap with the slit, and the attachment member includes an engaging plate configured to be engaged with the engaging hole.

8. The fixing device according to claim 1, wherein the belt guide is made of one plate metal.

9. The fixing device according to claim 1, wherein the slit is elongated in a direction orthogonally crossing to a longitudinal direction of the fixing belt.

10. An image forming apparatus comprising the fixing device according to claim 1.

* * * * *